US009736578B2

(12) United States Patent
Iyengar et al.

(10) Patent No.: US 9,736,578 B2
(45) Date of Patent: Aug. 15, 2017

(54) MICROPHONE-BASED ORIENTATION SENSORS AND RELATED TECHNIQUES

(71) Applicant: Apple Inc., Cupertino, CA (US)

(72) Inventors: Vasu Iyengar, Pleasonton, CA (US); Joshua D Atkins, Los Angeles, CA (US); Aram M. Lindahl, Menlo Park, CA (US); Tarun Pruthi, Fremont, CA (US); Ashrith Deshpande, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/732,770

(22) Filed: Jun. 7, 2015

(65) Prior Publication Data

US 2016/0360314 A1 Dec. 8, 2016

(51) Int. Cl.

| | |
|---|---|
| ***H04R 3/00*** | (2006.01) |
| ***H04R 1/40*** | (2006.01) |
| *G10L 21/0216* | (2013.01) |
| *G10L 21/0208* | (2013.01) |

(52) U.S. Cl.

CPC ..... *H04R 1/406* (2013.01); *H04R 3/005* (2013.01); *G10L 21/0208* (2013.01); *G10L 2021/02166* (2013.01); *H04R 2430/20* (2013.01); *H04R 2499/11* (2013.01)

(58) Field of Classification Search

CPC .... H04R 3/005; H04R 2499/11; H04R 1/406; H04R 2430/20; H04R 2430/23; H04R 2430/25; H04R 2430/21; H04R 29/004; G10L 2021/02166; G10L 21/0272; G10L 21/0208

See application file for complete search history.

(56) References Cited

U.S. PATENT DOCUMENTS

| | | | | |
|---|---|---|---|---|
| 6,937,980 | B2 | 8/2005 | Krasny et al. | |
| 7,146,013 | B1 * | 12/2006 | Saito | H04R 3/005 381/92 |
| 7,174,022 | B1 | 2/2007 | Zhang et al. | |
| 7,983,720 | B2 | 7/2011 | Chen et al. | |
| 8,175,291 | B2 | 5/2012 | Chan et al. | |
| 8,428,661 | B2 | 4/2013 | Chen et al. | |
| 8,626,498 | B2 | 1/2014 | Lee et al. | |
| 8,831,686 | B2 | 9/2014 | Hansson et al. | |
| 8,868,413 | B2 | 10/2014 | Siotis | |

(Continued)

FOREIGN PATENT DOCUMENTS

EP 2835958 A1 2/2015

*Primary Examiner* — Thang Tran

(74) *Attorney, Agent, or Firm* — Ganz Pollard, LLC

(57) ABSTRACT

An orientation detector can have a first microphone, a second microphone, and a reference microphone spaced from the first microphone and the second microphone. An orientation processor can be configured to determine an orientation of the first microphone, the second microphone, or both, relative to a user's mouth based on a comparison of a relative strength of a first signal associated with the first microphone to a relative strength of a second signal associated with the second microphone. A channel selector in a speech enhancer can select one signal from among several signals based at least in part on the orientation determined by the orientation processor. A mobile communication handset can include a microphone-based orientation detector of the type disclosed herein.

20 Claims, 8 Drawing Sheets

(56) References Cited

U.S. PATENT DOCUMENTS 8,948,416 B2 2/2015 Chen et al.
9,031,256 B2 5/2015 Visser et al.
9,245,527 B2 * 1/2016 Lindahl ..... G10L 15/32
2003/0027600 A1 2/2003 Krasny et al.
2003/0161484 A1 * 8/2003 Kanamori ..... H04R 3/005 381/71.7
2006/0147063 A1 7/2006 Chen
2009/0238377 A1 9/2009 Ramakrishnan et al.
2010/0017205 A1 * 1/2010 Visser ..... G10L 21/02 704/225
2011/0208520 A1 8/2011 Lee
2011/0288860 A1 11/2011 Schevciw et al.
2012/0057717 A1 * 3/2012 Nystrom ..... H04R 3/005 381/71.6
2012/0123772 A1 * 5/2012 Thyssen ..... G10L 21/0208 704/226
2012/0123774 A1 * 5/2012 Choi ..... H04L 49/90 704/228
2012/0230526 A1 * 9/2012 Zhang ..... H04R 25/407 381/313
2013/0166298 A1 * 6/2013 Harada ..... G10L 25/51 704/246
2013/0166299 A1 * 6/2013 Shimotani ..... G10L 25/84 704/246
2013/0272540 A1 * 10/2013 hgren ..... H04R 3/00 381/94.1
2013/0332157 A1 12/2013 Iyengar et al.
2014/0093091 A1 4/2014 Dusan et al.
2014/0188467 A1 7/2014 Jing et al.
2015/0110284 A1 * 4/2015 Niemisto ..... G10L 21/0208 381/71.1
2015/0350395 A1 * 12/2015 Jiang ..... H04R 3/005 455/570

* cited by examiner

MICROPHONE-BASED ORIENTATION SENSORS AND RELATED TECHNIQUES

BACKGROUND

This application, and the innovations and related subject matter disclosed herein, (collectively referred to as the "disclosure") generally concern microphone-based orientation detectors and associated techniques. More particularly but not exclusively, this disclosure pertains to sensors (also sometimes referred to as detectors) configured to determine an orientation of a device relative to a speaker's mouth, with a sensor configured to determine an orientation based in part on a difference in spectral power between two microphone signals being but one particular example of disclosed sensors.

Some commercially available communication handsets have two microphones. A first microphone is positioned in a region expected to be near a user's mouth during use of the handset, and the other microphone is spaced apart from the first microphone. With such an arrangement, the first microphone is intended to be positioned to receive the user's utterances directly, and the other microphone receives a comparatively attenuated version of the user's utterances, allowing a signal from the other microphone to be used as a noise reference.

Two-microphone arrangements as just described can provide a much more accurate noise spectrum estimate as compared to estimates obtained from a single microphone. With a relatively more accurate estimate of the noise spectrum, a noise suppressor can be used with relatively less distortion to the desired signal (e.g., a voice signal in context of a mobile communication device).

However, despite such benefits of two-channel noise suppression, if the first microphone is moved away from the user's mouth, as when the handset is repositioned during use, then the accuracy of the spectral noise estimate can decrease, as the first microphone can receive a more attenuated version of the speech signal. Consequently, the reference microphone signal can include relatively more voice components relative to the first microphone, leading to voice distortion because there is less spectral separation between the microphone transducers when the user speaks.

Therefore, a need exists for orientation detectors configured to detect when a microphone has been moved away from a user's mouth. In addition, a need exists for speech enhancers compatible with a wide range of handset use positions. As well, a need exists for improved noise-suppression systems for use in mobile communication handsets.

SUMMARY

The innovations disclosed herein overcome many problems in the prior art and address one or more of the aforementioned or other needs. In some respects, the innovations disclosed herein are directed to microphone-based orientation sensors and associated techniques, and more particularly but not exclusively, to sensors configured to determine an orientation of a device relative to a speaker's mouth. Some disclosed sensors are configured to determine an orientation based on a difference in spectral power as between first and second microphone signals relative to a reference microphone signal. Other disclosed sensors are configured to determine an orientation based on differences in spectral power among more than two microphone signals. Mobile communication handsets and other devices having such sensors and detectors also are disclosed.

An orientation detector and sensors are disclosed. A first microphone can have a first position, a second microphone can have a second position, and a reference microphone can be spaced from the first microphone and the second microphone. An orientation processor can be configured to determine an orientation of the first microphone, the second microphone, or both, relative to a position of a source of a targeted acoustic signal (e.g., a user's mouth) based on a comparison of a relative separation of a first signal associated with the first microphone to a relative separation of a second signal associated with the second microphone. Throughout this disclosure, reference is made to a user's mouth position. In context of a mobile handset, a user's mouth position is likely the most relevant source of a targeted acoustic signal. Other embodiments, however, can have acoustic sources other than a user's mouth. Accordingly, particular references to a user's mouth herein should be understood in a more general context as including other sources of acoustic signals.

The first signal can include or be a signal emitted by the first microphone transducer. In some instances, the first signal combines the signal emitted by the first microphone with a signal emitted by the second microphone. For example, the first signal can be a signal output from a beamformer. In some instances, the signal (or a portion thereof) emitted by the first microphone transducer can be more heavily weighted in the combination relative to the signal (or a portion thereof) emitted by the second microphone transducer. For example, in context of beamformers, a signal from a first microphone and a signal from a second microphone can be combined after being filtered to establish a suitable phase/delay of one signal relative to another signal, e.g., to achieve a desired beam directionality.

The second signal can include or be a signal emitted by the second microphone transducer. In some instances, the second signal combines the signal emitted by the second microphone with a signal emitted by the first microphone. The signal (or a portion thereof) emitted by the second microphone can be more heavily weighted in the combination relative to the signal emitted by the first microphone.

A measure of the separation of the first signal can include a difference in spectral power as between the first signal and a signal emitted by the reference microphone. A measure of the separation of the second signal can include a difference in spectral power as between the second signal and the signal emitted by the reference microphone.

Some orientation detectors also include a separation processor configured to determine a spectral power separation, relative to a signal emitted by the reference microphone transducer, of a signal emitted by the first microphone, a signal emitted by the second microphone, a first beam comprising the signal emitted by the first microphone and the signal emitted by the second microphone, and a second beam comprising the signal emitted by the first microphone and the signal emitted by the second microphone. The first beam can more heavily weight the signal emitted by the first microphone as compared to the signal emitted by the second microphone. Similarly, the second beam can more heavily weight the signal emitted by the second microphone as compared to the signal emitted by the first microphone. The first beam can have a directionality (sometimes also referred to in the art as a "look direction") corresponding to a first direction of rotation relative to a user's mouth. The second beam can have a directionality corresponding to a second direction of rotation relative to the user's mouth. The first and the second directions can differ from each other, and in some cases can be opposite relative to each other.

Although orientation detectors are described herein largely in relation to two microphones and two beams, this disclosure contemplates orientation detectors having more than two microphones, as well as more than two beams, e.g., to provide relative higher resolution orientation sensitivity in rotation about a given axis, or to add orientation sensitivity in rotation about one or more additional axes (e.g., pitch, yaw, and roll). Some orientation detectors have a voice-activity-detector configured to declare voice activity when the spectral power separation of at least one of the signals emitted by the first microphone, the signal emitted by the second microphone, the first beam, and the second beam exceeds a threshold spectral power separation.

The threshold spectral power separation can vary inversely with a level of stationary noise.

An axis can extend from the first microphone to the second microphone, and wherein the orientation processor is further configured to determine an extent of rotation of the axis relative to a neutral position based on the comparison of the separation of the first signal to the separation of the second signal.

Some orientation detectors include one or more of a gyroscope, an accelerometer, and a proximity detector. A communication connection can link the orientation processor with one or more of the gyroscope, the accelerometer, and the proximity detector. The orientation processor can determine the orientation based at least in part on an output from one or more of the gyroscope, the accelerometer, and the proximity detector. In some instances, the orientation determined based in part on an output from one or more of the gyroscope, the accelerometer, and the proximity detector can be relative to a fixed frame of reference (e.g., the earth) rather than relative to a user's mouth.

An orientation determined by the orientation detector can be one of pitch, yaw, or roll. The orientation detector can also include a fourth microphone spaced apart from the first microphone, the second microphone and the reference microphone. The orientation processor can be configured to determine an angular rotation in the other two of pitch, yaw, and roll, based at least in part based on a comparison of a relative separation of a signal associated with the fourth microphone relative to the respective separations of the signals associated with the first and the second microphones.

Communication handsets are disclosed. A handset can have a chassis with a front side, a back side, a top edge, and a bottom edge. A first microphone and a second microphone can be spaced apart from the first microphone. The first and the second microphones can be positioned on or adjacent to the bottom edge of the chassis. A reference microphone can face the back side of the chassis and be positioned closer to the top edge than to the bottom edge. An orientation detector can be configured to detect an orientation of the chassis relative to a user's mouth based at least in part on a strength of a signal from the first microphone relative to a signal from the reference microphone compared to a strength of a signal from the second microphone relative to the signal from the reference microphone.

Some disclosed handsets also have a noise suppressor and a signal selector configured to direct to the noise suppressor a signal which is selected from one of the signal from the first microphone, the signal from the second microphone, an average of the signal from the first microphone and the signal from the second microphone, a first beam comprising a first combination of the signal from the first microphone with the signal from the second microphone, and a second beam comprising a second combination of the signal from the first microphone and the signal from the second microphone. The first combination can weight the signal from the first microphone more heavily as compared to the signal from the second microphone. The second combination can weight the signal from the second microphone more heavily as compared to the signal from the first microphone.

In some instances, the selector is configured to equalize a signal from the reference microphone to match a far-field response of the first beam signal, the second beam signal, or both, in diffuse noise.

The noise suppressor can be configured, in some instances, to subject the signal from the reference microphone to a minimum spectral profile corresponding to a system spectral noise profile of one or both of the first beam and the second beam.

Some communication handsets also have one or more of a gyroscope, an accelerometer, and a proximity detector and a communication connection between the orientation detector and the one or more of the gyroscope, the accelerometer, and the proximity detector.

Some communication handsets also have a calibration data store containing a correlation between an angle of the chassis relative to a user's mouth and the strength of the signal from the first microphone compared to the strength of the signal from the second microphone. Such calibration data can also contain a correlation between an angle of the chassis relative to a user's mouth and a strength of one or more beams.

In some instances, a measure of the orientation of the chassis relative to the user's mouth comprises an extent of rotation from a neutral position. In general, but not always, the user's mouth is substantially centered between the first microphone and the second microphone in the neutral position.

Some communication handsets have a fourth microphone spaced apart from the bottom edge of the chassis. The orientation detector can further be configured to determine an angular rotation in each of pitch, yaw, and roll, based at least in part on a strength of a signal from the fourth microphone relative to a signal from the reference microphone.

Also disclosed are tangible, non-transitory computer-readable media including computer executable instructions that, when executed, cause a computing environment to implement a disclosed orientation detection method.

The foregoing and other features and advantages will become more apparent from the following detailed description, which proceeds with reference to the accompanying drawings.

BRIEF DESCRIPTION OF THE DRAWINGS

Unless specified otherwise, the accompanying drawings illustrate aspects of the innovations described herein. Referring to the drawings, wherein like numerals refer to like parts throughout the several views and this specification, several embodiments of presently disclosed principles are illustrated by way of example, and not by way of limitation.

FIG. 4 also schematically illustrates a pair of beams using handset microphones.

DETAILED DESCRIPTION

The following describes various innovative principles related orientation-detection systems, orientation detection techniques, and related signal processors, by way of reference to specific orientation-detection system embodiments, which are but several particular examples chosen for illustrative purposes. More particularly but not exclusively, disclosed subject matter pertains, in some respects, to systems for detecting an orientation of a handset relative to a user's mouth.

Nonetheless, one or more of the disclosed principles can be incorporated in various other signal processing systems to achieve any of a variety of corresponding system characteristics. Techniques and systems described in relation to particular configurations, applications, or uses, are merely examples of techniques and systems incorporating one or more of the innovative principles disclosed herein. Such examples are used to illustrate one or more innovative aspects of the disclosed principles.

Thus, orientation-detection techniques (and associated systems) having attributes that are different from those specific examples discussed herein can embody one or more of the innovative principles, and can be used in applications not described herein in detail, for example, in "hands-free" communication systems, in hand-held gaming systems or other console systems, etc. Accordingly, such alternative embodiments also fall within the scope of this disclosure.

I. Overview

Figure 3:
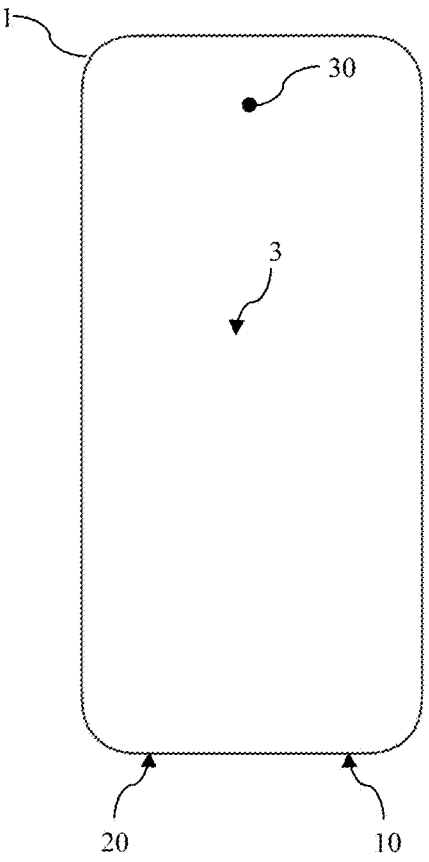
FIGS. 3 and 4 show plan views of the handset illustrated in FIG. 1 from a back side.
Figure 2:
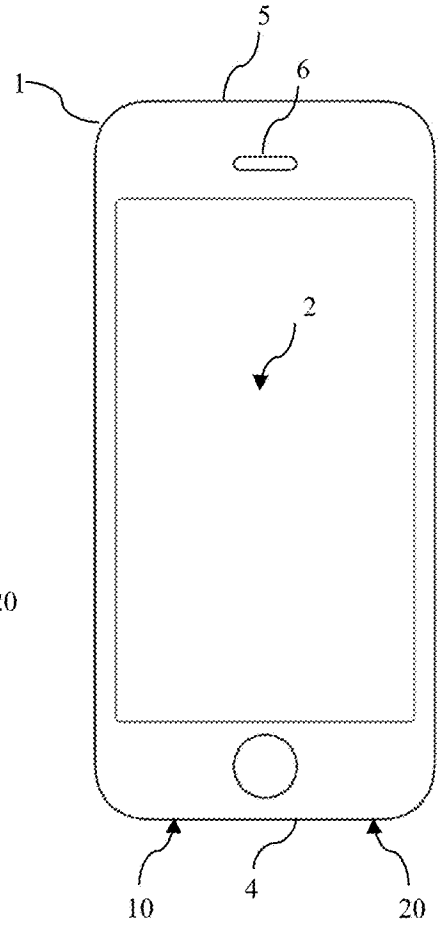
FIG. 2 shows a plan view of the handset illustrated in FIG. 1 from a front side.
Figure 1:
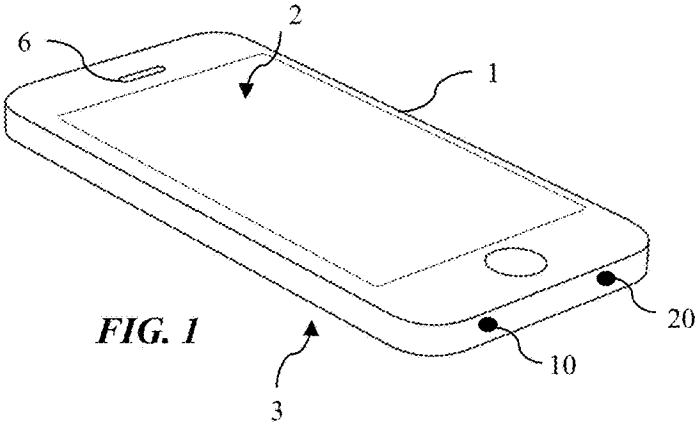
FIG. 1 shows an isometric view of a mobile communication handset.
Figure 5:
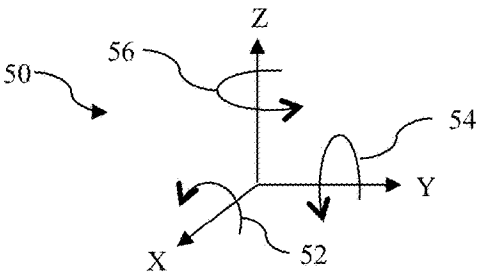
FIG. 5 shows a Cartesian coordinate system and illustrates rotation in roll, pitch and yaw.

FIGS. 1, 2 and 3 show a mobile communication device 1 having a front side 2 and a backside 3, a bottom edge 4 and a top edge 5, and a front-facing loudspeaker 6. A first microphone 10 and a second microphone 20 are positioned along the bottom edge 4. In other examples, one or both microphones 10, 20 can be positioned on the front or the back sides 2, 3, or along the edges extending between the bottom edge and the top edge. In any event, the first microphone 10 and the second microphone 20 are positioned in a region contemplated to be close to a user's mouth during use of the device 1 as a handset. As shown in FIG. 3, a third microphone 30 can be spaced apart from the bottom edge 4 and be positioned relatively closer to the top edge 5 than the bottom edge.

Figure 4:
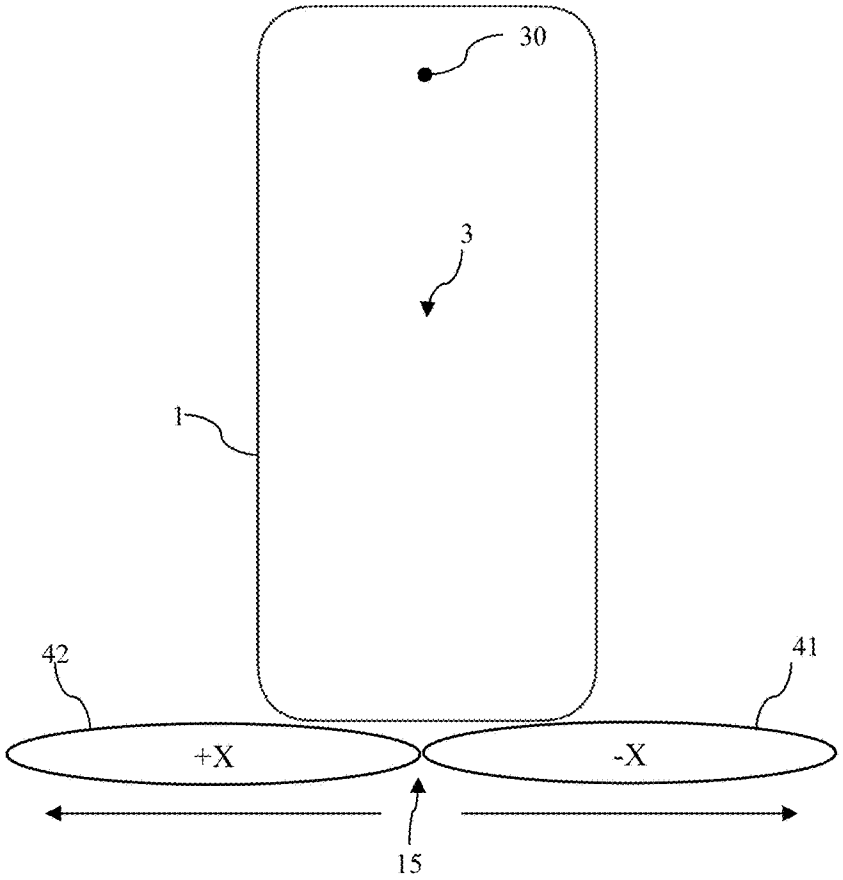

With a configuration as shown in FIGS. 1-3, the microphones 10, 20 can be used to form beams in the left 42 and right 41 directions, as shown in FIG. 4, even when the device 1 tilts toward the left or the right relative to the user's mouth. The near-field effects of the beams can provide increased separation (as compared to the use of just one microphone) relative to a signal from the reference microphone 30, even when the device 1 tilts towards the left or right, In some respects, this disclosure describes techniques for deciding which beam to use and under which circumstances. For example, if a user's mouth position is adjacent a center region 15 between the microphones 10, 20, an average of the signals (M1+M4)/2 can be used to collect a user's utterance. Alternatively, it might be preferred to use one of the beams, or one of the microphones M1 or M4, if the user's mouth position is biased toward the left or right of the bottom of the handset.

As used herein, the term "M1" refers to a signal from a first microphone 10, the term "M4" refers to a signal from a second microphone 20, and the term "M2" refers to a signal from the reference microphone 30.

II. Microphone-based Orientation Detection

With two microphones 10, 20, any of M1, M4, or beams formed using M1 and M4, can be used for noise-suppression in conjunction with the noise reference microphone M2. In an attempt to minimize voice distortion while achieving desirable noise suppression, a microphone signal or beam having the highest spectral separation when the near-end voice is active can be selected.

Let M1(k) and M2(k) denote the power spectrum of the output signal from the first microphone 10 and the reference microphone 30 respectively. Then the separation is defined, generally, as a separation function: sep(M1(k), M2(k)). In one particular embodiment, the separation function is defined as follows:

$$sep = \left(\frac{1}{N}\right)\sum_{k=1}^{N}(10*\log_m(M1(k)) - 10*\log_m(M2(k)))$$

Separation between output signals from the second microphone 20 and the reference microphone 30 can be defined similarly. For beams that are formed from output signals from the first and second microphones 10, 20, the separation can be computed in a similar fashion, but with the output signal from the reference microphone 30 equalized to have the same far-field response as the beams. Such equalization allows the system to suppress noise introduced by beamforming.

A. Orientation Detection Based on Separation

Figure 6:
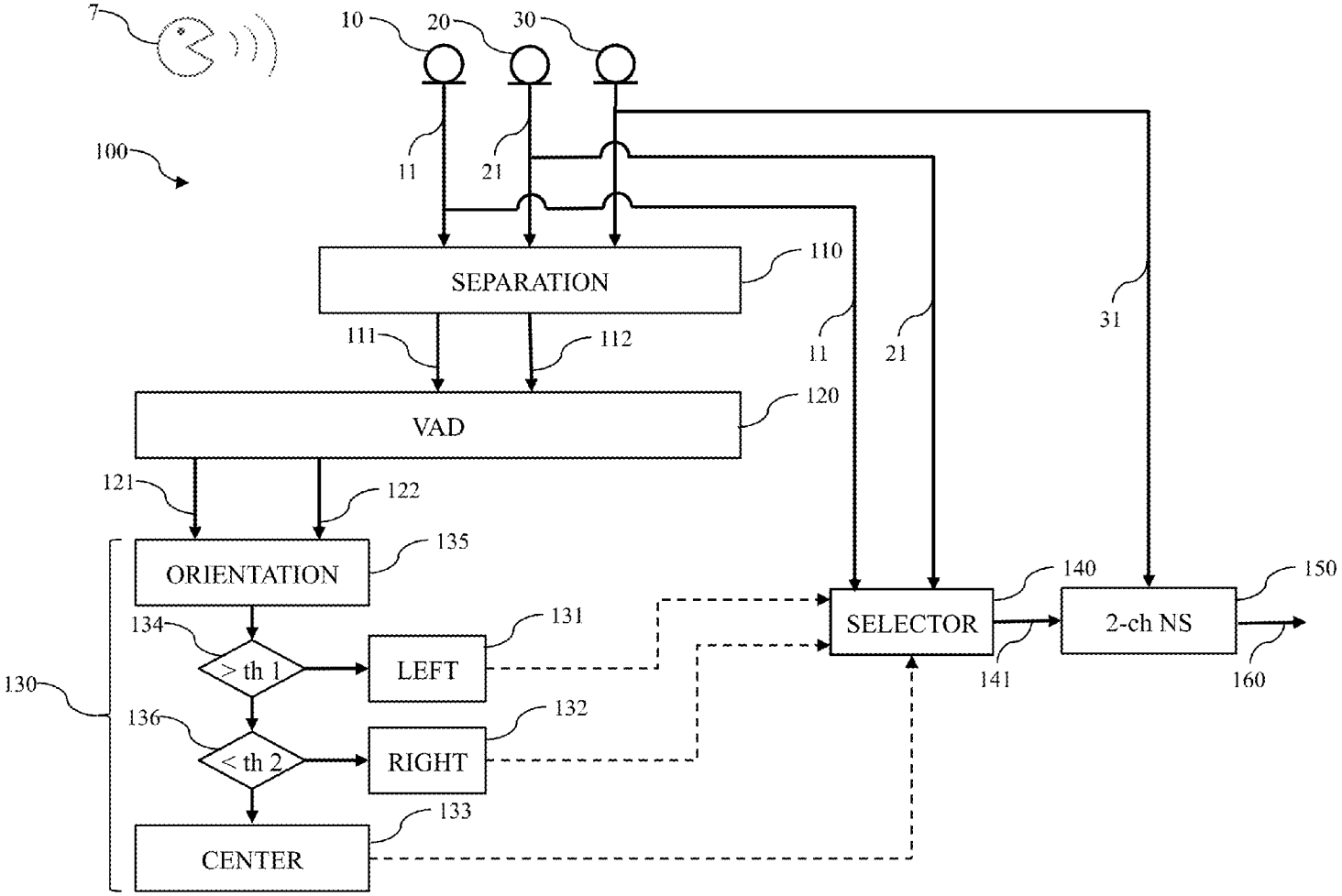
FIG. 6 schematically illustrates a speech enhancement system including an orientation processor.

FIG. 6 shows an example of a near-end speech enhancer 100. The speech enhancer has a separation calculator 110 and a voice-activity detector (VAD) 120. A separation-based orientation processor 130 detects an orientation of the device 1. Based on an output 131, 132, 133 from the orientation processor 130, a selector 140 selects a signal 11 from the first microphone 10 or a signal 21 from the second microphone 20.

Raw separation 111 between output signals from the first microphone 10 and the reference microphone 30, and raw separation 112 between output signals from the second microphone 20 and the reference microphone 30, respectively, denoted by sep(M1(k), M2(k)) and sep(M4(k), M2(k)), respectively, can be computed. Some time and frequency smoothing can be applied.

Since we are trying to determine the position of a near-end talker's mouth with respect to the bottom microphones 10, 20 of the device 1, separation data will only be considered during near-end speech. In this example, the VAD 120 considers the near-end talker to be active when the following condition is met:

$$\max(\mathrm{sep}(M1(k),M2(k)) \text{ and } \mathrm{sep}(M4(k), M2(k)))>\text{Threshold}.$$

The threshold can be a function of stationary noise, and typically can be reduced as the stationary noise level increases. In FIG. 6, the output 121 and output 122 are smoothed separation metrics gated by near-end voice activity. The orientation comparator 135 computes a difference in sep(M1(k), M2(k)) and sep(M4(k), M2(k)). If either of sep(M1(k), M2(k)) and sep(M4(k), M2(k)) is greater than the other by more than a given threshold 134, 136, the orientation processor 130 determines a non-neutral orientation 131, 132 for the device 1, and the selector 140 can choose to output a corresponding signal, e.g., a signal from the microphone showing the larger separation. If the separations computed at 110 are within a given range of each other, the detector can determine the user's mouth is centered 133 and the selector 140 can choose to average the signals from the microphones 10, 20. In other instances, the selector 140 can choose a different signal output (e.g., can output a signal from a microphone or a beam that last was selected by the selector 140). In the example in FIG. 6, only microphone signals are used for position detection and a selector 140 switches between Ml (i.e., a signal from the first microphone 10) and M4 (i.e., a signal from the second microphone 20) based on detected position. In other embodiments, the selector 140 can select a desired combination of M1 and M4, including one or more selected beams having any of a plurality of look directions.

The noise suppressor 150 suppresses noise from the selected signal 141 before emitting the output 160 from the speech enhancer 100.

Figure 7:
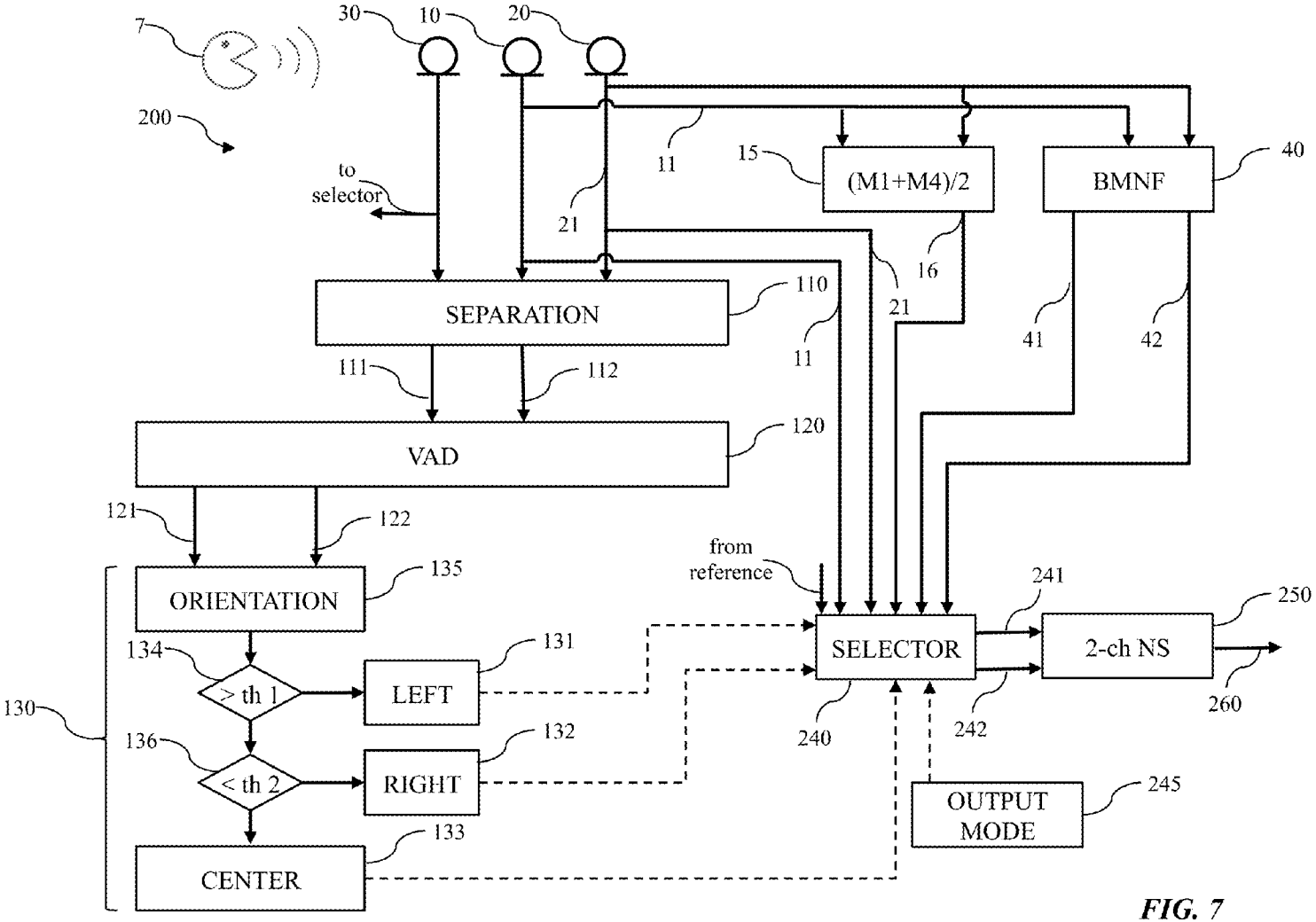
FIG. 7 schematically illustrates another embodiment of a speech enhancement system including an orientation processor of the type shown in FIG. 6.

FIG. 7 shows another example of a speech enhancement system 200. For conciseness, features in FIG. 7 that are similar to or the same as features in FIG. 6 retain reference numerals from FIG. 6. As with the system 100, the microphones 10, 20, 30 in the system 200 are used for orientation detection, but the selector 240 can select from among beams 41, 42 (+X and −X) and the average microphone response 16 ((M1+M4)/2) determined by the signal averager 15, as well as from among outputs signals from each of the microphones, again depending on detected orientation of the device 1 relative to the user's mouth 7. In some examples, the selector can select a microphone signal or beam that was last selected.

The selector 240 can output an equalized noise signal 241 and the selected speech signal 242. The noise suppressor 250 can process the speech signal 242 and emit an output signal from 260 from the speech enhancer 200.

An output mode selector 245 can set an operating mode for the selector 240. For example, the selector can choose from between M1 and M4, between +X and −X, from among M1, M4 and (M1+M4)/2, or from among +X, −X and (M1+M4)/2. Where a beam (e.g., −X or +X) is selected for voice input (e.g., input 242), a signal from the reference microphone 30 (e.g., via the selector 240 as indicated in FIG. 7) can be equalized to reflect the far-field beam response. As well, a lower bound can be imposed to reflect system noise arising from beamforming.

Figure 8:
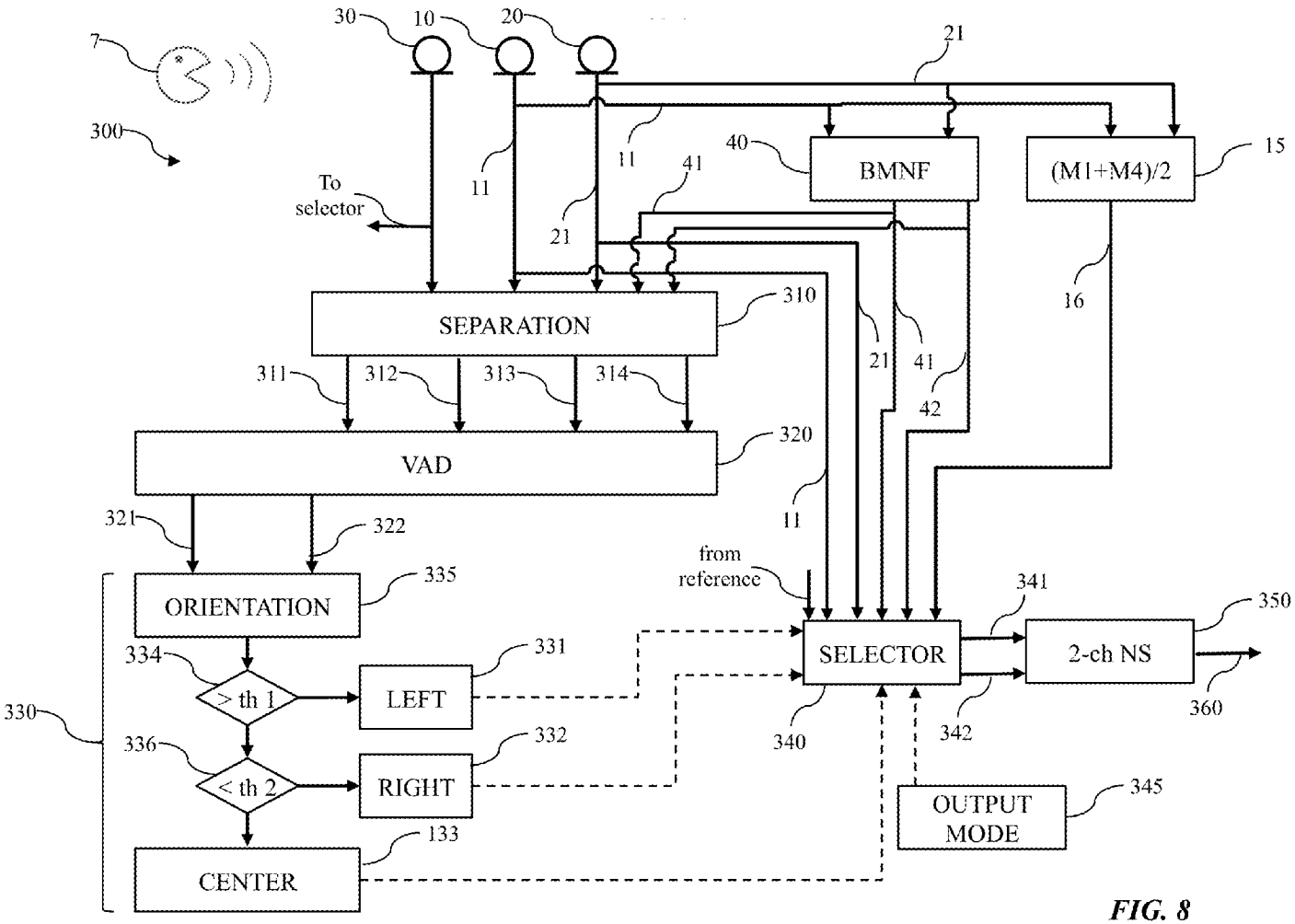
FIG. 8 schematically illustrates yet another embodiment of a speech enhancement system including an orientation processor similar to the type shown in FIG. 6.

With a VAD as indicated in FIG. 8, near-end voice activity can be determined according to the following:

$$\max(\mathrm{sep}(M1(k),M2(k)),\mathrm{sep}(M4(k),M2(k)),\mathrm{sep}(+X(k), M2(k)),\mathrm{sep}(-X(k),M2(k)))>\text{Threshold},$$

where sep(+X(k), M2(k)) 313 and sep(−X(k), M2(k)) 314 are respective measures of separation of the beams. Signals 311 and 312 represent separation of the microphone channels 10, 20 relative to the reference microphone signal.

Other features in FIG. 8 that are the same as features in FIG. 7 retain reference numerals from FIG. 7. Similar components share similar reference numerals, although the reference numerals in FIG. 8 are generally incremented by 100 compared to reference numerals in FIG. 7 to reflect component differences driven by processing of the beams 41, 42.

The VAD output 321, 322 can be microphone or beam separation measures gated by voice activity. The orientation comparator 335 can receive and process any of the signal or beam separations. Including the beam separations in this way can enable near-end voice activity over a wider range of angles than in other embodiments. Such improvement can clearly be seen from the separation data shown in FIG. 9, which shows average separation versus angular mouth position for microphone signals 404, 405 and beam signals 401, 402. The beam signals are shown to maintain greater separation as compared to the microphone signals over relatively large deviations of angular mouth positions.

Figure 9:
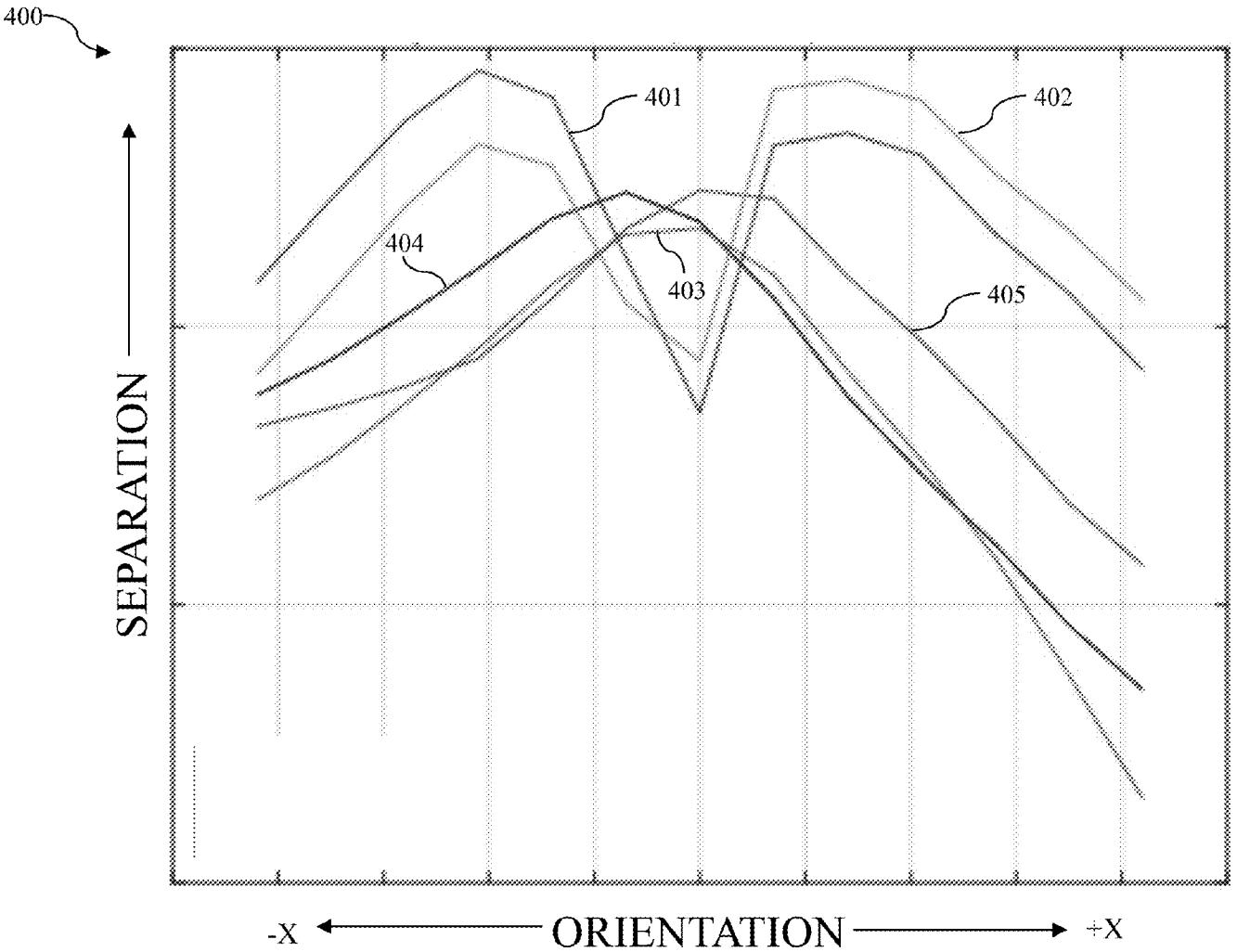
FIG. 9 shows a correlation between spectral power separation and extent of rotation from a neutral position relative to a user's mouth.

The data shown in FIG. 9 demonstrates several correlations between average separation and angular mouth position for microphone signals 404, 405 and beam signals 401, 402 for a given microphone-based orientation detector. In some instances, such correlations can be used to determine an angular mouth position based on observed or acquired separation data during use of a device having a microphone-based orientation detector of the type used to generate the correlations.

Thus, a disclosed orientation detector can estimate an angular displacement from a neutral orientation (e.g., an orientation in which the user's mouth is adjacent a defined region of a handset, for example centered between the microphones 10, 20). In some embodiments, such estimates can be relatively coarse—the detector can reflect that the device 1 is oriented so as to place a user's mouth relatively nearer one microphone than the other. In other embodiments, as such estimates can be relatively more refined—the detector can accurately reflect an extent of angular rotation from a neutral orientation up to about 50 degrees. Some embodiments accurately reflect an extent of angular rotation from a neutral orientation up to between about 25 degrees and about 55 degrees, such as between about 30 degrees and about 45 degrees, with about 40 being another exemplary extent of angular rotation that disclosed detectors can discern accurately. Some estimates of angular rotation relative to a user's mouth are accurate to within between about 1 degree and about 15 degrees, for example between about 3 degrees and about 8 degrees, with about 5 degrees being a particular example of accuracy of disclosed detectors.

An output mode selector 345 can set an operating mode for the selector 340. For example, the selector can choose between M1 and M4, between −X and +X, among M1, M4 and (M1+M4)/2, or among +X, −X and (M1+M4)/2.

B. Combined Orientation Detection Approaches

Some devices 1 are equipped with one or more of a gyroscope (or "gyro"), a proximity sensor and an accelerometer. The gyro and accelerometer can determine an angular position of a given device with respect to Earth in a quick, reliable and accurate manner. In addition, such orientation detection is robust to noise and does not rely on or require near-end voice activity. However, a difficulty in using the gyro in the current context of speech enhancement is that it provides orientation with respect to Earth and not with respect to a user's mouth. Nonetheless, the gyro can be used together with any separation-based or other microphone-based orientation technique disclosed herein to provide a rapid response to angular phone movement. This concept is generally illustrated in the schematic illustration in FIG. 10.

Separation Based Position Detection (SBPD) (also sometimes referred to more generally as microphone-based orientation detection) can be performed as described above at 510. The position reading from the gyro or other orientation sensor can be output at 530 to the SBPD 510 in a continuous manner. The SBPD 510 can make a determination of Left, Center, or Right position whenever there is sufficient near-end voice activity, and the orientation sensor output is recorded at that time. Whenever the SBPD 510 detects a change in orientation, the corresponding orientation sensor output readings can be checked to see if the change in detected position is confirmed by the orientation sensor's angle change in magnitude and/or sign.

If the two orientation approaches reach different conclusions, then the output of the SBPD 510 can be declared to be in error and rejected. Errors can occur more often due to noise.

Figure 10:
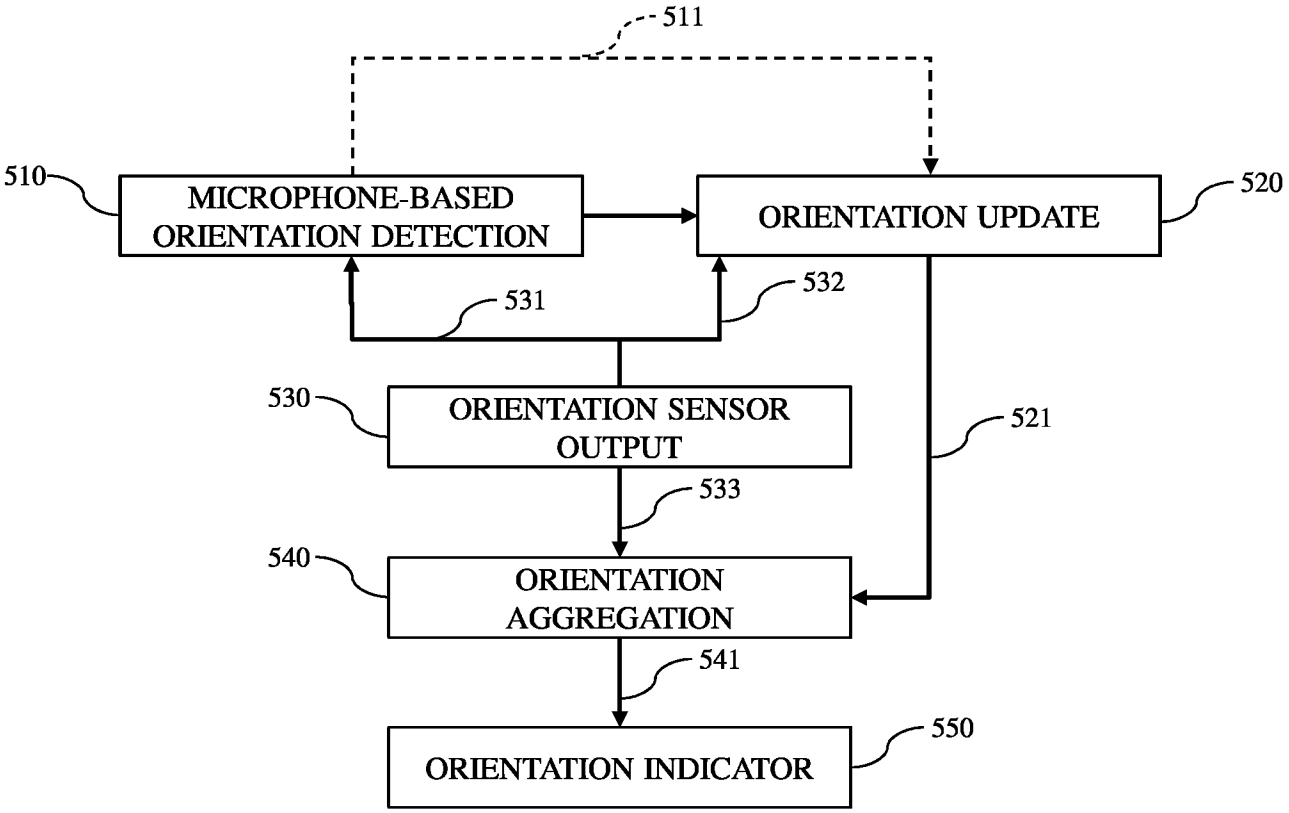
FIG. 10 shows a hybrid system having a microphone-based orientation detector and an orientation sensor.

Another aspect of the method shown in FIG. 10 is a further aggregation of SBPD 510 and Gyro Based Position Detection hereby called Separation and Gyro Based Position Detection (SGBPD). Whenever an SBPD decision is made, the decision along with an update flag 511 can be sent to a processing block 520 that updates average Gyro (or other sensor output) readings for each position, Left, Center, and Right. (The rest of this discussion proceeds with reference to a Gyro, but those of ordinary skill in the art will appreciate that any other orientation sensor or detector can be used in place of a Gyro.)

An SGBPD can then be made by comparing the current Gyro reading with average Gyro readings Gyro_Left, Gyro_Center and Gyro_Right 521 corresponding to Left, Center, Right orientations. An instantaneous Aggregate orientation 540 determination can be made by comparing the current Gyro position to <Gyro_Left, Gyro_Center and Gyro_Right>. An output from the aggregate orientation 540 can result in an indication 550 of orientation (e.g., a user-interpretable or a machine-readable) indication.

In some embodiments, information from the gyro (or another orientation-sensitive device, including other microphone-based orientation detectors, e.g., having 3 or more microphones for orientation detection) can be combined with any of the microphone-based orientation detection systems described herein algorithm to detect a finer resolution of orientation relative to a user's mouth than just left/center/right.

If a proximity sensor indicates the device is removed from a user's ear and no longer is being held in a "handset" position with a user's mouth near the microphones 10, 20, the noise estimation can be based only on one microphone, e.g., microphone 30.

IV. Computing Environments

Figure 11:
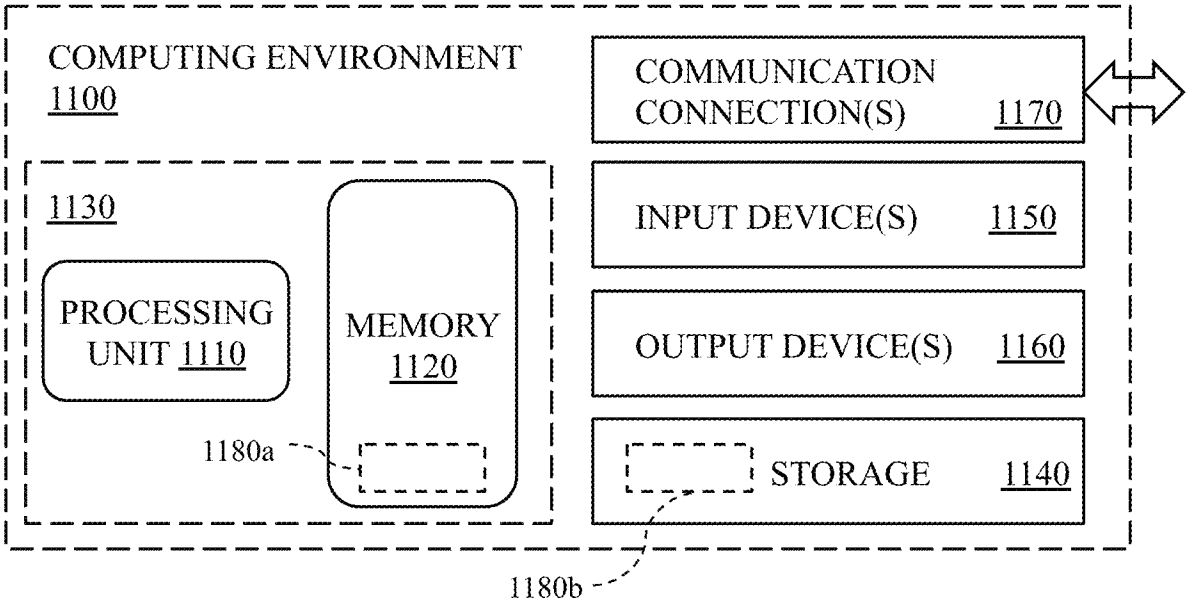
FIG. 11 shows a schematic illustration of a computing environment suitable for implementing one or more technologies disclosed herein.

FIG. 11 illustrates a generalized example of a suitable computing environment 1100 in which described methods, embodiments, techniques, and technologies relating, for example, to speech recognition can be implemented. The computing environment 1100 is not intended to suggest any limitation as to scope of use or functionality of the technologies disclosed herein, as each technology may be implemented in diverse general-purpose or special-purpose computing environments. For example, each disclosed technology may be implemented with other computer system configurations, including hand held devices (e.g., a mobile-communications device, or, more particularly, IPHONE®/IPAD® devices, available from Apple, Inc. of Cupertino, Calif.), multiprocessor systems, microprocessor-based or programmable consumer electronics, network PCs, minicomputers, mainframe computers, smartphones, tablet computers, and the like. Each disclosed technology may also be practiced in distributed computing environments where tasks are performed by remote processing devices that are linked through a communications connection or network. In a distributed computing environment, program modules may be located in both local and remote memory storage devices.

The computing environment 1100 includes at least one central processing unit 1110 and memory 1120. In FIG. 11, this most basic configuration 1130 is included within a dashed line. The central processing unit 1110 executes computer-executable instructions and may be a real or a virtual processor. In a multi-processing system, multiple processing units execute computer-executable instructions to increase processing power and as such, multiple processors can be running simultaneously. The memory 1120 may be volatile memory (e.g., registers, cache, RAM), non-volatile memory (e.g., ROM, EEPROM, flash memory, etc.), or some combination of the two. The memory 1120 stores software 1180*a* that can, for example, implement one or more of the innovative technologies described herein.

A computing environment may have additional features. For example, the computing environment 1100 includes storage 1140, one or more input devices 1150, one or more output devices 1160, and one or more communication connections 1170. An interconnection mechanism (not shown) such as a bus, a controller, or a network, interconnects the components of the computing environment 1100. Typically, operating system software (not shown) provides an operating environment for other software executing in the computing environment 1100, and coordinates activities of the components of the computing environment 1100.

The store 1140 may be removable or non-removable, and can include selected forms of machine-readable media. In general machine-readable media includes magnetic disks, magnetic tapes or cassettes, CD-ROMs, CD-RWs, DVDs, magnetic tape, optical data storage devices, and carrier waves, or any other machine-readable medium which can be used to store information and which can be accessed within the computing environment 1100. The storage 1140 stores instructions for the software 1180, which can implement technologies described herein.

The store 1140 can also be distributed over a network so that software instructions are stored and executed in a distributed fashion. In other embodiments, some of these operations might be performed by specific hardware components that contain hardwired logic. Those operations might alternatively be performed by any combination of programmed data processing components and fixed hardwired circuit components.

The input device(s) 1150 may be a touch input device, such as a keyboard, keypad, mouse, pen, touchscreen or trackball, a voice input device, a scanning device, or another device, that provides input to the computing environment 1100. For audio, the input device(s) 1150 may include a microphone or other transducer (e.g., a sound card or similar device that accepts audio input in analog or digital form), or a CD-ROM reader that provides audio samples to the computing environment 1100. The output device(s) 1160 may be a display, printer, speaker, CD-writer, or another device that provides output from the computing environment 1100.

The communication connection(s) 1170 enable communication over a communication medium (e.g., a connecting network) to another computing entity. The communication medium conveys information such as computer-executable instructions, compressed graphics information, or other data in a modulated data signal.

Tangible machine-readable media are any available, tangible media that can be accessed within a computing environment 1100. By way of example, and not limitation, with the computing environment 1100, computer-readable media include memory 1120, storage 1140, communication media (not shown), and combinations of any of the above. Tangible computer-readable media exclude transitory signals.

V. Other Embodiments

The examples described above generally concern orientation-detection systems and related techniques. Other embodiments than those described above in detail are contemplated based on the principles disclosed herein, together with any attendant changes in configurations of the respective apparatus described herein. Incorporating the principles disclosed herein, it is possible to provide a wide variety of systems adapted to detect an orientation of a device relative to a signal source.

For example, additional microphones can be added as between the microphones 10, 20 to improve the sensitivity and resolution of available beams in resolving changes in orientation relative to a user's mouth. For example, additional beams can be generated and have a finer resolution across a particular range of angular positions relative to a user's mouth. As another example, one or more microphones can be added to the device at other respective positions spaced apart from the lower edge 4. By comparing separation of such additional microphones relative to separation of the microphones 10, 20, additional orientation information can be gathered, permitting resolution of orientations in pitch, yaw, and roll.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by references in its entirety for all purposes.

The principles described above in connection with any particular example can be combined with the principles described in connection with another example described herein. Accordingly, this detailed description shall not be construed in a limiting sense, and following a review of this disclosure, those of ordinary skill in the art will appreciate the wide variety of filtering and computational techniques that can be devised using the various concepts described herein. Moreover, those of ordinary skill in the art will appreciate that the exemplary embodiments disclosed herein can be adapted to various configurations and/or uses without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

Thus, in view of the many possible embodiments to which the disclosed principles can be applied, we reserve to the right to claim any and all combinations of features and technologies described herein as understood by a person of ordinary skill in the art, including, for example, all that comes within the scope and spirit of the following claims.

We currently claim:

1. An orientation detector comprising:

a first microphone transducer having a first position, a second microphone transducer having a second position, and a reference microphone transducer spaced from the first microphone transducer and the second microphone transducer, wherein each microphone transducer is configured to emit a respective signal in correspondence with an acoustic signal received by the respective microphone transducer;

a separation unit; and an orientation processor configured to determine an orientation of the first microphone transducer, the second microphone transducer, or both, relative to a source of the acoustic signal based on a comparison of a first computed signal-separation associated with the first microphone transducer and the reference microphone transducer to a second computed signal-separation associated with the second microphone transducer and the reference microphone transducer;

wherein the separation unit generates the first computed signal-separation and the second computed signal-separation.

2. The orientation detector according to claim 1, wherein the first computed signal-separation corresponds, at least in part, to a signal emitted by the first microphone transducer.

3. The orientation detector according to claim 2, wherein the first computed signal-separation further corresponds to a combination of the signal emitted by the first microphone transducer with a signal emitted by the second microphone transducer, wherein at least a portion of the signal emitted by the first microphone transducer is more heavily weighted in the combination relative to at least a portion of the signal emitted by the second microphone transducer.

4. The orientation detector according to claim 2, wherein the second computed signal-separation corresponds, at least in part, to a signal emitted by the second microphone transducer.

5. The orientation detector according to claim 4, wherein the second computed signal-separation further corresponds to a combination of the signal emitted by the second microphone transducer with a signal emitted by the first microphone transducer, wherein at least a portion of the signal emitted by the second microphone transducer is more heavily weighted in the combination relative to at least a portion of the signal emitted by the first microphone transducer.

6. The orientation detector according to claim 1, wherein a measure of the first computed signal-separation associated with -the first microphone transducer and the reference microphone transducer comprises a difference in spectral power as between a signal emitted by the first microphone transducer and a signal emitted by the reference microphone transducer, and a measure of the second computed-signal separation associated with the second microphone transducer and the reference microphone transducer comprises a difference in spectral power as between a signal emitted by the second microphone transducer and the signal emitted by the reference microphone transducer.

7. The orientation detector according to claim 1, further comprising:

a separation processor configured to determine a spectral power separation, relative to a signal emitted by the reference microphone transducer, of a signal emitted by the first microphone transducer, a signal emitted by the second microphone transducer, a first beam comprising the signal emitted by the first microphone transducer and the signal emitted by the second microphone transducer, and a second beam comprising the signal emitted by the first microphone transducer and the signal emitted by the second microphone transducer, the source of the acoustic signal, and a directionality of the second beam corresponds to a second direction of rotation relative to the source of the acoustic signal.

8. The orientation detector according to claim 7, further comprising a voice-activity-detector configured to declare voice activity when the spectral power separation of at least one of the signal emitted by the first microphone transducer, the signal emitted by the second microphone transducer, the first beam, and the second beam exceeds a threshold spectral power separation.

9. The orientation detector according to claim 8, wherein the threshold spectral power separation varies inversely with a level of stationary noise.

10. The orientation detector according to claim 1, wherein an axis extends from the first microphone transducer to the second microphone transducer, and wherein the orientation processor is further configured to determine an extent of rotation of the axis relative to a neutral position based on the comparison of the first computed signal-separation to the first computed signal-separation.

11. The orientation detector according to claim 1, further comprising one or more of a gyroscope, an accelerometer, and a proximity detector and a communication connection between the orientation processor and the one or more of the gyroscope, the accelerometer, and the proximity detector, wherein the orientation processor determines the orientation based at least in part on an output from the one or more of the gyroscope, the accelerometer, and the proximity detector.

12. The orientation detector according to claim 1, wherein the orientation is one of pitch, yaw, or roll, the orientation detector further comprising a fourth microphone transducer spaced apart from the first microphone transducer, the second microphone transducer and the reference microphone transducer, wherein the orientation processor is further configured to determine an angular rotation in the other two of pitch, yaw, and roll, based at least in part based on a comparison of a third computed signal-separation associated with the fourth microphone transducer and another of the microphone transducers to the first computed signal-separation, the second computed signal-separation, or both, wherein the separation unit generates the third computed signal-separation.

13. A communication handset comprising:

a chassis having a front side, a back side, a top edge, and a bottom edge;

a first microphone and a second microphone spaced apart from the first microphone, wherein the first and the second microphones are positioned on or adjacent to the bottom edge of the chassis;

a reference microphone facing the back side of the chassis and positioned closer to the top edge than to the bottom edge; and an orientation detector configured to detect an orientation of the chassis relative to an acoustic source based at least in part on a strength of a signal from the first microphone relative to a signal from the reference microphone compared to a strength of a signal from the second microphone relative to the signal from the reference microphone.

14. The communication handset according to claim 13, further comprising a noise suppressor and a signal selector configured to direct to the noise suppressor a selected one of the signal from the first microphone, the signal from the second microphone, an average of the signal from the first microphone and the signal from the second microphone, a first beam comprising a first combination of the signal from the first microphone with the signal from the second microphone, and a second beam comprising a second combination of the signal from the first microphone and the signal from the second microphone, wherein a directionality of the first beam corresponds to a first direction of rotation relative to the acoustic source and a directionality of the second beam corresponds to a second direction of rotation relative to the acoustic source.

15. The communication handset according to claim 14, wherein the selector is configured to equalize a signal from the reference microphone to match a far-field response of the first beam signal, the second beam signal, or both, in diffuse noise.

16. The communication handset according to claim 14, wherein the noise suppressor is configured to subject the signal from the reference microphone to a minimum spectral profile corresponding to a system spectral noise profile of one or both of the first beam and the second beam.

17. The communication handset according to claim 13, further comprising one or more of a gyroscope, an accelerometer, and a proximity detector and a communication connection between the orientation detector and the one or more of the gyroscope, the accelerometer, and the proximity detector for resolving the orientation of the chassis relative to a fixed frame of reference.

18. The communication handset according to claim 13, further comprising a calibration data store containing a correlation between an angle of the chassis relative to a selected acoustic source and the strength of the signal from the first microphone compared to the strength of the signal from the second microphone, wherein the orientation detector is further configured to detect the orientation of the chassis relative to the acoustic source based at least in part on the correlation.

19. The communication handset according to claim 13, wherein a measure of the orientation of the chassis relative to the acoustic source comprises an extent of rotation from a neutral position, wherein the acoustic source is substantially centered between the first microphone and the second microphone in the neutral position.

20. The communication handset according to claim 13, further comprising a fourth microphone spaced apart from the bottom edge of the chassis, wherein the orientation detector is further configured to determine an angular rotation in each of pitch, yaw, and roll, based at least in part on a strength of a signal from the fourth microphone relative to a signal from the reference microphone.

* * * * *